US007510489B2

(12) United States Patent
Higuchi

(10) Patent No.: US 7,510,489 B2
(45) Date of Patent: Mar. 31, 2009

(54) SOLID GOLF BALL

(75) Inventor: Hiroshi Higuchi, Chichibu (JP)

(73) Assignee: Bridgestone Sports Co., Ltd., Tokyo (KP)

( * ) Notice: Subject to any disclaimer, the term of this patent is extended or adjusted under 35 U.S.C. 154(b) by 0 days.

(21) Appl. No.: 12/017,528

(22) Filed: Jan. 22, 2008

(65) Prior Publication Data

US 2008/0194358 A1 Aug. 14, 2008

Related U.S. Application Data

(63) Continuation of application No. 11/705,453, filed on Feb. 13, 2007, now Pat. No. 7,344,455.

(51) Int. Cl.
*A63B 37/06* (2006.01)

(52) U.S. Cl. ..... 473/377

(58) Field of Classification Search ..... 473/377
See application file for complete search history.

(56) References Cited

U.S. PATENT DOCUMENTS

| | | | |
|---|---|---|---|
| 4,570,937 | A | 2/1986 | Yamada |
| 5,516,110 | A | 5/1996 | Yabuki et al. |
| 5,752,889 | A | 5/1998 | Yamagishi et al. |
| 5,803,833 | A | 9/1998 | Nakamura et al. |
| 5,848,943 | A | 12/1998 | Sano et al. |
| 5,929,189 | A | 7/1999 | Ichikawa et al. |
| 6,277,924 | B1 | 8/2001 | Hamada et al. |
| 6,302,810 | B2 | 10/2001 | Yokota |
| 6,386,993 | B1 | 5/2002 | Yokota |
| 6,582,325 | B1 | 6/2003 | Ichikawa et al. |

(Continued)

FOREIGN PATENT DOCUMENTS

JP 6-98949 A 4/1994

(Continued)

OTHER PUBLICATIONS

Report of Research and Development, vol. 23, No. 9, pp. 5-15 Mar. 10, 1994.

(Continued)

*Primary Examiner*—Raeann Trimiew
(74) *Attorney, Agent, or Firm*—Sughrue Mion, PLLC

(57) ABSTRACT

The invention provides a solid golf ball having a solid core and a cover layer that encases the core and has an outermost layer on an outside surface of which are formed a plurality of dimples. The solid core is formed of a rubber composition composed of 100 parts by weight of a base rubber that includes 60 to 100 parts by weight of a polybutadiene rubber having a cis-1,4 bond content of at least 60% and synthesized using a rare-earth catalyst, 0.1 to 5 parts by weight of an organosulfur compound, an unsaturated carboxylic acid or a metal salt thereof, an inorganic filler, and an antioxidant. The solid core has a deformation, when compressed under a final load of 130 kgf from an initial load of 10 kgf, of 2.0 to 4.0 mm, and has a specific hardness distribution. The cover layer is formed primarily of a polyurethane material and has a thickness of 0.5 to 2.5 mm, a Shore D hardness at the surface of 50 to 70 and a flexural rigidity of 50 to 300 MPa. The golf ball has a deformation, when compressed under a final load of 130 kgf from an initial load of 10 kgf, of 2.0 to 3.8 mm. The solid golf ball is advantageous overall in competitive use.

18 Claims, 1 Drawing Sheet

U.S. PATENT DOCUMENTS

| | | | | |
|---|---|---|---|---|
| 6,642,314 | B2 | 11/2003 | Sone et al. | |
| 6,758,766 | B2 | 7/2004 | Watanabe | |
| 6,786,836 | B2 | 9/2004 | Higuchi et al. | |
| 6,837,804 | B2 | 1/2005 | Watanabe et al. | |
| 6,887,168 | B2 | 5/2005 | Hayashi et al. | |
| 7,059,975 | B2 | 6/2006 | Sasaki et al. | |
| 7,344,455 | B1 * | 3/2008 | Higuchi | 473/377 |
| 2004/0147694 | A1 | 7/2004 | Sone et al. | |
| 2005/0009641 | A1 * | 1/2005 | Higuchi et al. | 473/371 |

FOREIGN PATENT DOCUMENTS

| | | | |
|---|---|---|---|
| JP | 7-268132 | A | 10/1995 |
| JP | 9-215778 | A | 8/1997 |
| JP | 9-271538 | A | 10/1997 |
| JP | 9-308708 | A | 12/1997 |
| JP | 10-127823 | A | 5/1998 |
| JP | 11-35633 | A | 2/1999 |
| JP | 11-178949 | A | 7/1999 |
| JP | 11-290479 | A | 10/1999 |
| JP | 2001-259080 | A | 9/2001 |
| JP | 2002-293996 | A | 10/2002 |
| JP | 2002-355338 | A | 12/2002 |
| JP | 2003-70936 | A | 3/2003 |
| JP | 2003-180879 | A | 7/2003 |
| JP | 2004-180793 | A | 7/2004 |

OTHER PUBLICATIONS

Mason et al., "Hydrolysis of Tri-tert-butylaluminum", J. Am Chem Soc. 1993, vol. 115, pp. 4971-4984.

Harlan et al., "Three-Coordinate Aluminum is Not a Prerequisite for Catalytic Activity in the Zirconocene", J. Am Chem. Soc., 1995, vol. 117, pp. 6465-6474.

* cited by examiner

SOLID GOLF BALL

This is a Continuation of application Ser. No. 11/705,453 filed Feb. 13, 2007, the contents of which are incorporated by reference as if fully set forth herein.

BACKGROUND OF THE INVENTION

The present invention relates to a solid golf ball having a solid core and a cover layer which encases the core. More particularly, the invention relates to a solid golf ball which has a good deformation, especially on full shots with a driver at low head speeds, and thus an excellent flight performance, which also has a good controllability on approach shots and a good feel on impact, and which moreover has an excellent scuff resistance and durability to cracking.

Two-piece solid golf balls designed to satisfy the overall characteristics desired in a golf ball, such as good flight performance, feel on impact and controllability on approach shots, have hitherto been improved in various ways. One example is the golf ball described in JP-A 6-98949.

However, because such a golf ball has a hard cover, there are problems with its spin performance.

In addition, JP-A 9-308708, JP-A 2003-70936 and JP-A 2003-180879, for example, disclose solid golf balls in which the feel and controllability have been improved without a loss of rebound or cut resistance by setting the thickness, flexural rigidity and Shore D hardness of the cover within specific ranges.

Yet, because these golf balls have an inadequate core resilience and the core hardness distribution has not been optimized, properties such as the distance and the spin performance leave something to be desired.

JP-A 9-215778, JP-A 9-271538 and JP-A 11-178949 disclose solid golf balls in which a polyurethane material is used as the cover material. However, in these golf balls, the core lacks an adequate resilience and the resin from which the cover is formed has a less than adequate scuff resistance. Hence, there remains room for improvement in the distance traveled by the ball and the scuff resistance of the cover.

The golf balls described in JP-A 2002-355338 and JP-A 2004-180793 do have a good core resilience, but because these balls have a large deflection hardness and are soft, the rebound by the ball decreases, resulting in a less than satisfactory distance.

Moreover, in JP-A 2002-355338, an ionomer is used as the cover material, but the golf ball has a poor scuff resistance and the core does not have an optimized hardness distribution, as a result of which the ball rebound remains insufficient.

With regard to two-piece solid golf balls, JP-A 11-290479, JP-A 10-127823 and JP-A 2001-25908 describe art in which the hardness distribution such as at the center and surface of a rubber core is optimized. Yet, the rubber core in these golf balls has a resilience which falls short of what is desired, leaving room for improvement in the distance traveled by the ball.

Accordingly, it is an object of the present invention to provide a solid golf ball which has a good deformation, especially on full shots with a driver at low head speeds, and thus an excellent flight performance, which also has a good controllability on approach shots and a good feel on impact, and which moreover has an excellent scuff resistance and durability to cracking.

SUMMARY OF THE INVENTION

The inventor, having conducted extensive investigations in order to achieve the above object, has found that when, as the primary improvement in a solid golf ball having a polyurethane cover with relatively soft properties, a suitable amount of antioxidant is added to the core-forming rubber composition so as to soften the core surface and thus optimize the core hardness distribution by making the core hardest at the interior thereof, there can be obtained a golf ball having an even better distance when struck with a driver at a low head speed (HS) in a range of about 30 to 40 m/s, and an improved feel on impact and scuff resistance. Moreover, in this solid golf ball, compared with conventional cover layers made of materials such as ionomer resins, the cover layer has a low flexural rigidity for the hardness thereof, which affords the ball an excellent spin performance and spin stability. In addition, this solid golf ball has an excellent scuff resistance and excellent durability to cracking with repeated impact. Based on these findings, the solid golf ball of the invention has the following solid core I and cover layer II, and has a deformation, when compressed under a final load of 130 kgf from an initial load of 10 kgf, of from 2.0 to 3.8 mm.

I. Solid Core (i) The solid core is formed of a rubber composition composed of 100 parts by weight of a base rubber that includes from 60 to 100 parts by weight of a polybutadiene rubber having a cis-1,4 bond content of at least 60% and synthesized using a rare-earth catalyst, from 0.1 to 5 parts by weight of an organosulfur compound, an unsaturated carboxylic acid or a metal salt thereof, an inorganic filler, and an antioxidant.

(ii) The solid core has a deformation, when compressed under a final load of 130 kgf from an initial load of 10 kgf, of from 2.0 to 4.0 mm.

(iii) The solid core has the hardness distribution shown in the table below.

TABLE 1

| Hardness Distribution in Solid Core | Shore D hardness |
|---|---|
| Center | 30 to 48 |
| Region located 5 mm from center | 34 to 52 |
| Region located 10 mm from center | 40 to 58 |
| Region located 15 mm from center (Q) | 43 to 61 |
| Region located 2 to 3 mm inside of surface (R) | 36 to 54 |
| Surface (S) | 41 to 59 |
| Hardness difference [(Q) − (S)] | 1 to 10 |
| Hardness difference [(S) − (R)] | 3 to 10 |

II. Cover Layer (i) The cover layer is formed primarily of a polyurethane material.

(ii) The cover layer has a thickness of from 0.5 to 2.5 mm, a Shore D hardness at the surface of from 50 to 70, and a flexural rigidity of from 50 to 300 MPa.

Accordingly, the invention provides the following solid golf balls.

[1] A solid golf ball comprising a solid core and a cover layer that encases the core and has an outermost layer on an outside surface of which are formed a plurality of dimples, wherein the solid core is formed of a rubber composition composed of 100 parts by weight of a base rubber that includes from 60 to 100 parts by weight of a polybutadiene rubber having a cis-1,4 bond content of at least 60% and synthesized using a rare-earth catalyst, from 0.1 to 5 parts by weight of an organosulfur compound, an unsaturated carboxylic acid or a metal salt thereof, an inorganic filler, and an antioxidant; the solid core has a deformation, when compressed under a final load of 130 kgf from an initial load of 10 kgf, of from 2.0 to 4.0 mm, and has the hardness distribution shown in the table below; the cover layer is formed primarily of a polyurethane material and has a thickness of from 0.5 to 2.5 mm, a Shore D hardness at the surface of from 50 to 70 and a flexural rigidity of from 50 to 300 MPa; and the golf ball has a deformation, when compressed under a final load of 130 kgf from an initial load of 10 kgf, of from 2.0 to 3.8 mm.

| Hardness Distribution in Solid Core | Shore D hardness |
|---|---|
| Center | 30 to 48 |
| Region located 5 mm from center | 34 to 52 |
| Region located 10 mm from center | 40 to 58 |
| Region located 15 mm from center (Q) | 43 to 61 |
| Region located 2 to 3 mm inside of surface (R) | 36 to 54 |
| Surface (S) | 41 to 59 |
| Hardness difference [(Q) − (S)] | 1 to 10 |
| Hardness difference [(S) − (R)] | 3 to 10 |

[2] The solid golf ball of [1], wherein the surface hardness of the solid core is lower than the surface hardness of the cover layer, the difference therebetween in Shore D hardness units being from 5 to 20.

[3] The solid golf ball of [1], wherein the difference between the surface hardness of the solid core and the center hardness of the solid core, in Shore D hardness units, is from 7 to 17.

[4] The solid golf ball of [1], wherein the solid core has a diameter of from 37.6 to 43.0 mm and the golf ball has a diameter of from 42.67 to 44.0 mm.

[5] The solid golf ball of [1], wherein the solid core contains from 33 to 45 parts by weight of the unsaturated carboxylic acid or a metal salt thereof, from 0.1 to 1.0 part by weight of the organic peroxide, from 5 to 80 parts by weight of the inorganic filler, and from 0.2 to 1.0 part by weight of the antioxidant per 100 parts by weight of the base rubber.

[6] The solid golf ball of [1], wherein the dimples total in number from 250 to 450, have an average depth of from 0.125 to 0.150 mm and an average diameter of from 3.7 to 5.0 mm for all dimples, and are configured from at least four dimple types.

BRIEF DESCRIPTION OF THE DIAGRAMS

DETAILED DESCRIPTION OF THE INVENTION

Figure 1:
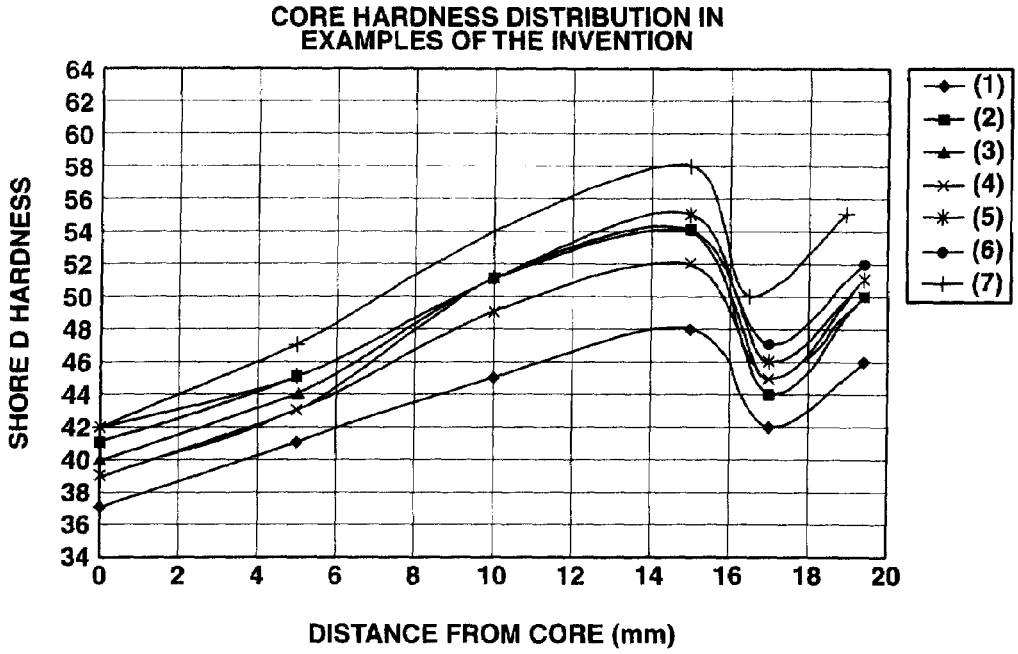
FIG. 1 shows the core hardness distributions for core formulations No. 1 to No. 7 used in the examples of the invention.

The invention is described more fully below. The solid golf ball according to the invention has a solid core and a cover layer that encloses the solid core.

The solid core is a hot-molded material made of a rubber composition in which polybutadiene serves as the base rubber.

The polybutadiene must have a cis-1,4 bond content of at least 60%, preferably at least 80%, more preferably at least 90%, and most preferably at least 95%; and a 1,2-vinyl bond content of generally 2% or less, preferably 1.7% or less, and most preferably 1.5% or less. Outside of this range, the resilience decreases.

It is recommended that the polybutadiene have a Mooney viscosity ($ML_{1+4}$ (100° C.)) of at least 30, preferably at least 35, more preferably at least 40, even more preferably at least 50, and most preferably at least 52, but preferably not more than 100, more preferably not more than 80, even more preferably not more than 70, and most preferably not more than 60.

The term "Mooney viscosity" used herein refers in each instance to an industrial indicator of viscosity (JIS K6300) as measured with a Mooney viscometer, which is a type of rotary plastometer. The unit symbol used is $ML_{1+4}$ (100° C.), where "M" stands for Mooney viscosity, "L" stands for large rotor (L-type), "1+4" stands for a pre-heating time of 1 minute and a rotor rotation time of 4 minutes, and the "100° C." indicates that measurement was carried out at a temperature of 100° C.

The polybutadiene has a polydispersity index Mw/Mn (where Mw is the weight-average molecular weight, and Mn is the number-average molecular weight) of generally at least 2.0, preferably at least 2.2, more preferably at least 2.4, and even more preferably at least 2.6, but generally not more than 6.0, preferably not more than 5.0, more preferably not more than 4.0, and even more preferably not more than 3.4. A polydispersity Mw/Mn which is too small may lower the workability, whereas one that is too large may lower the rebound.

The polybutadiene is one that is synthesized with a rare-earth catalyst. A known rare-earth catalyst may be used for this purpose.

Exemplary rare-earth catalysts include those made up of a combination of a lanthanide series rare-earth compound, an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon group of 1 to 8 carbons).

Preferred alumoxanes include compounds of the structures shown in formulas (I) and (II) below. The alumoxane association complexes described in *Fine Chemical* 23, No. 9, 5 (1994), *J. Am. Chem. Soc.* 115, 4971 (1993), and *J. Am. Chem. Soc.* 117, 6465 (1995) are also acceptable.

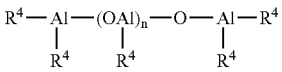

(I)

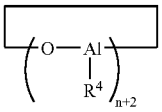

(II)

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$ (wherein X is a halogen; R is a hydrocarbon group of 1 to 20 carbons, such as an alkyl, aryl or aralkyl; and n is 1, 1.5, 2 or 3); strontium halides such as $Me_3SrCl$, $Me_2SrCl_2MeSrHCl_2$ and $MeSrCl_3$; and other metal halides such as silicon tetrachloride, tin tetrachloride and titanium tetrachloride.

The Lewis base can be used to form a complex with the lanthanide series rare-earth compound. Illustrative examples include acetylacetone and ketone alcohols.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Preferred examples of such rare-earth catalysts include those mentioned in JP-A 11-35633.

The polymerization of butadiene in the presence of a rare-earth catalyst may be carried out by bulk polymerization or vapor phase polymerization, either with or without the use of solvent, and at a polymerization temperature in a range of generally −30 to +150° C., and preferably 10 to 100° C.

The polybutadiene may be a modified polybutadiene obtained by polymerization using the above-described rare-earth catalyst, followed by the reaction of a terminal modifier with active end groups on the polymer.

A known terminal modifier may be used for this purpose. Illustrative examples include compounds of types (i) to (vii) below.

(i) The modified polybutadiene can be obtained by reacting an alkoxysilyl group-bearing compound with active end groups on the polymer. Preferred alkoxysilyl group-bearing compounds are alkoxysilane compounds having at least one epoxy group or isocyanate group on the molecule. Specific examples include epoxy group-bearing alkoxysilanes such as 3-glycidyloxypropyltrimethoxysilane, 3-glycidyloxypropyltriethoxysilane, (3-glycidyloxypropyl)methyldimethoxysilane, (3-glycidyloxypropyl)methyldiethoxysilane, β-(3,4-epoxycyclohexyl)trimethoxysilane, β-(3,4-epoxycyclohexyl)triethoxysilane, β-(3,4-epoxycyclohexyl)methyldimethoxysilane, β-(3,4-epoxycyclohexyl)ethyldimethoxysilane, condensation products of 3-glycidyloxypropyltrimethoxysilane, and condensation products of (3-glycidyloxypropyl)methyldimethoxysilane; and isocyanate group-bearing alkoxysilane compounds such as 3-isocyanatopropyltrimethoxysilane, 3-isocyanatopropyltriethoxysilane, (3-isocyanatopropyl)methyldimethoxysilane, (3-isocyanatopropyl)methyldiethoxysilane, condensation products of 3-isocyanatopropyltrimethoxysilane and condensation products of (3-isocyanatopropyl)methyldimethoxysilane.

A Lewis acid can be added to accelerate the reaction when the above alkoxysilyl group-bearing compound is reacted with active end groups. The Lewis acid acts as a catalyst to promote the coupling reaction, thus improving cold flow by the modified polymer and providing a better shelf stability. Examples of suitable Lewis acids include dialkyltin dialkyl malates, dialkyltin dicarboxylates and aluminum trialkoxides.

Other types of terminal modifiers that may be used include:

(ii) halogenated organometallic compounds, halogenated metallic compounds and organometallic compounds of the general formulas $R^5_nM'X_{4-n}$, $M'X_4$, $M'X_3$, $R^5_nM'(—R^6—COOR^7)_{4-n}$ or $R^5_nM'(—R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain a pendant carbonyl or ester group; M' is a tin, silicon, germanium or phosphorus atom; X is a halogen atom; and n is an integer from 0 to 3);

(iii) heterocumulene compounds having on the molecule a Y═C═Z linkage (wherein Y is a carbon, oxygen, nitrogen or sulfur atom; and Z is an oxygen, nitrogen or sulfur atom);

(iv) three-membered heterocyclic compounds containing on the molecule the following bonds

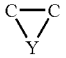

(wherein Y is an oxygen, nitrogen or sulfur atom);

(v) halogenated isocyano compounds;

(vi) carboxylic acids, acid halides, ester compounds, carbonate compounds and acid anhydrides of the formula $R^8—(COOH)_m$, $R^9(COX)_m$, $R^{10}—(COO—R^{11})$, $R^{12}—OCOO—R^{13}$, $R^{14}—(COOCO—R^{15})_m$ or

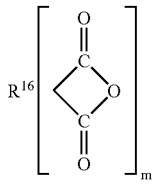

(wherein $R^8$ to $R^{16}$ are each independently a hydrocarbon group of 1 to 50 carbons, X is a halogen atom, and m is an integer from 1 to 5); and (vii) carboxylic acid metal salts of the formula $R^{17}_1M''(OCOR^{18})_{4-1}$, $R^{19}_1M''(OCO—R^{20}—COOR^{21})_{4-1}$ or

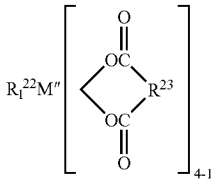

(wherein $R^{17}$ to $R^{23}$ are each independently a hydrocarbon group of 1 to 20 carbons, M" is a tin, silicon or germanium atom, and the letter l is an integer from 0 to 3).

Specific examples of the above terminal modifiers (i) to (vii) and methods for their reaction are described in, for example, JP-A 11-35633, JP-A 7-268132 and JP-A 2002-293996.

It is critical for the above-described polybutadiene to be included within the base rubber in an amount of at least 60 wt %, preferably at least 70 wt %, more preferably at least 80 wt %, and most preferably at least 90 wt %, and up to 100 wt %, preferably up to 98 wt %, and more preferably up to 95 wt %. If the amount of the above polybutadiene included is too small, a golf ball endowed with a good rebound will be difficult to obtain.

Rubbers other than the above polybutadiene may also be used and included, insofar as the objects of the invention are attainable. Specific examples include polybutadiene rubbers (BR), styrene-butadiene rubbers (SBR), natural rubbers, polyisoprene rubbers and ethylene-propylene-diene rubbers (EPDM). These may be used individually or as combinations of two or more thereof.

The hot-molded material serving as the solid core is molded from a rubber composition which includes as essential components specific amounts of an unsaturated carboxylic acid or a metal salt thereof, an organosulfur compound, an inorganic filler and an antioxidant per 100 parts by weight of the above-described base rubber.

Specific examples of the unsaturated carboxylic acid include acrylic acid, methacrylic acid, maleic acid and fumaric acid. Acrylic acid and methacrylic acid are especially preferred.

Illustrative examples of the metal salt of the unsaturated carboxylic acid include the zinc and magnesium salts of unsaturated fatty acids such as zinc methacrylate and zinc acrylate. The use of zinc acrylate is especially preferred.

The above unsaturated carboxylic acid and/or metal salt thereof are included in an amount per 100 parts by weight of the base rubber of at least 30 parts by weight, preferably at least 31 parts by weight, more preferably at least 32 parts by weight, and most preferably at least 33 parts by weight, but not more than 45 parts by weight, preferably not more than 43 parts by weight, even more preferably not more than 41 parts by weight, and most preferably not more than 40 parts by weight. Too much unsaturated carboxylic acid component will make the core too hard, giving the golf ball an unpleasant feel on impact. On the other hand, too little will result in a lower rebound.

The organosulfur compound is an essential ingredient for imparting a good resilience. Specifically, it is recommended that a thiophenol, thionaphthol or halogenated thiophenol, or a metal salt thereof, be included. Specific examples include pentachlorothiophenol, pentafluorothiophenol, pentabromothiophenol, p-chlorothiophenol, the zinc salt of pentachlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

The amount of the organosulfur compound included per 100 parts by weight of the base rubber is at least 0.1 part by weight, preferably at least 0.2 part by weight, more preferably at least 0.3 part by weight, even more preferably at least 0.4 part by weight, and most preferably at least 0.7 part by weight, but not more than 5 parts by weight, preferably not more than 4 parts by weight, more preferably not more than 3 parts by weight, even more preferably not more than 2 parts by weight, and most preferably not more than 1.5 parts by weight. Too much organosulfur compound makes the core too soft, whereas too little makes an improvement in resilience unlikely.

Illustrative examples of the inorganic filler include zinc oxide, barium sulfate and calcium carbonate. The amount included per 100 parts by weight of the base rubber is generally at least 5 parts by weight, preferably at least 6 parts by weight, even more preferably at least 7 parts by weight, and most preferably at least 8 parts by weight, but generally not more than 80 parts by weight, preferably not more than 60 parts by weight, more preferably not more than 40 parts by weight, and most preferably not more than 20 parts by weight. Too much or too little inorganic filler will make it impossible to obtain a proper golf ball weight and a suitable rebound.

The organic peroxide may be a commercially available product, suitable examples of which include those produced under the trade name designations Percumyl D (NOF Corporation), Perhexa 3M (NOF Corporation), Perhexa C (NOF Corporation), and Luperco 231XL (Atochem Co.). The use of Perhexa 3M or Perhexa C is preferred.

This organic peroxide may be of one type or a mixture of two or more types. The admixture of two or more different organic peroxides is desirable for further enhancing the resilience.

The amount of organic peroxide per 100 parts by weight of the base rubber is generally at least 0.1 part by weight, preferably at least 0.2 part by weight, even more preferably at least 0.3 part by weight, and most preferably at least 0.4 part by weight, but generally not more than 1.0 part by weight, preferably not more than 0.8 part by weight, more preferably not more than 0.6 part by weight, even more preferably not more than 0.5 part by weight, and most preferably not more than 0.45 part by weight. Too much or too little organic peroxide may make it impossible to obtain a suitable hardness distribution and, in turn, a good feel on impact, durability and rebound.

In the present invention, it is critical to include an antioxidant. By including a suitable amount of an antioxidant, it is possible to produce a core having a distinctive core hardness distribution in which an intermediate region inside the core has the greatest hardness. Examples of suitable commercial antioxidants include Nocrac NS-6, Nocrac NS-30 (both available from Ouchi Shinko Chemical Industry Co., Ltd.), and Yoshinox 425 (available from Yoshitomi Pharmaceutical Industries, Ltd.).

To achieve a good rebound and durability, it is recommended that the amount of antioxidant included per 100 parts by weight of the base rubber be at least 0.2 part by weight, preferably at least 0.23 part by weight, more preferably at least 0.25 part by weight, even more preferably at least 0.27 part by weight, and most preferably at least 0.3 part by weight, but not more than 1 part by weight, preferably not more than 0.8 part by weight, more preferably not more than 0.7 part by weight, and most preferably not more than 0.6 part by weight.

The solid core (hot-molded material) may be obtained by vulcanizing and curing the above-described rubber composition by a method similar to that used for known golf ball rubber compositions. Vulcanization may be carried out, for example, at a temperature of from 100 to 200° C. for a period of 10 to 40 minutes. In this case, to obtain the desired crosslinked rubber core of the invention, it is preferable for the vulcanization temperature to be at least 150° C., and especially at least 155° C., but not more than 200° C., preferably not more than 190° C., even more preferably not more than 180° C., and most preferably not more than 170° C.

The solid core has a deformation, when compressed under a final load of 130 kgf from an initial load of 10 kgf, of at least 2.0 mm, preferably at least 2.2 mm, more preferably at least 2.4 mm, and most preferably at least 2.6 mm, but not more than 4.0 mm, preferably not more than 3.4 mm, more preferably not more than 3.3 mm, even more preferably not more than 3.2 mm, and most preferably not more than 3.0 mm. If the solid core has too small a deformation, the feel of the ball on impact will worsen and the ball will take on too much spin, particularly on long shots taken with a club such as a driver in which the ball undergoes large deformation. On the other hand, a solid core that is too soft deadens the feel of the ball when played, compromises the rebound of the ball, resulting in a shorter distance, and gives the ball a poor durability to cracking with repeated impact.

In the invention, the solid core has the hardness distribution shown in the following table.

TABLE 2

| Hardness Distribution in Solid Core | Shore D hardness |
|---|---|
| Center | 30 to 48 |
| Region located 5 mm from center | 34 to 52 |
| Region located 10 mm from center | 40 to 58 |
| Region located 15 mm from center (Q) | 43 to 61 |
| Region located 2 to 3 mm inside of surface (R) | 36 to 54 |
| Surface (S) | 41 to 59 |
| Hardness difference [(Q) − (S)] | 1 to 10 |
| Hardness difference [(S) − (R)] | 3 to 10 |

The solid core has a center hardness, in Shore D hardness units, of at least 30, preferably at least 33, more preferably at least 35, and most preferably at least 37, but not more than 48, preferably not more than 45, more preferably not more than 43, and most preferably not more than 41.

The solid core has a hardness in the region thereof located 5 mm from the core center, in Shore D hardness units, of at least 34, preferably at least 37, more preferably at least 39, and most preferably at least 41, but not more than 52, preferably not more than 49, more preferably not more than 47, and most preferably not more than 45.

The solid core has a hardness in the region thereof located 10 mm from the core center, in Shore D hardness units, of at least 40, preferably at least 43, more preferably at least 45, and most preferably at least 47, but not more than 58, preferably not more than 55, more preferably not more than 53, and most preferably not more than 51.

The solid core has a hardness in the region thereof located 15 mm from the core center, in Shore D hardness units, of at least 43, preferably at least 46, more preferably at least 48, and most preferably at least 50, but not more than 61, preferably not more than 58, more preferably not more than 56, and most preferably not more than 54.

The solid core has a hardness in the region thereof located 2 to 3 mm inside of the core surface, in Shore D hardness units, of at least 36, preferably at least 39, more preferably at least 41, and most preferably at least 43, but not more than 54, preferably not more than 51, more preferably not more than 49, and most preferably not more than 47.

The solid core has a hardness at the surface, in Shore D hardness units, of at least 41, preferably at least 44, more preferably at least 46, and most preferably at least 48, but not more than 59, preferably not more than 56, even more preferably not more than 54, and most preferably not more than 52. If the Shore D hardness is too low, the rebound of the ball may decrease. On the other hand, if it is too high, the feel on impact may be too hard, in addition to which the spin rate on shots taken with a driver may increase, which may result in a shorter distance.

If the Shore D hardness in the core cross-section and the Shore D hardness at the core surface are too low, the rebound will decrease. On the hand, if these hardnesses are too high, the ball will have an excessively hard feel on impact, in addition to which the spin rate on shots with a driver will increase, shortening the distance traveled by the ball.

The hardness difference between the surface and center of the solid core, in Shore D hardness units, is at least 7, preferably at least 8, and most preferably at least 9, but not more than 17, preferably not more than 15, more preferably not more than 14, and most preferably not more than 12. At a hardness difference smaller than the foregoing range, the spin rate on shots taken with a driver will increase and the distance traveled by the ball will decrease. Conversely, at a hardness difference larger than the above-indicated range, the rebound and durability of the ball will decrease.

To enhance the rebound of the ball from suitable ball deformation on shots with a driver at low head speeds, and to improve both the feel on impact and the scuff resistance of the ball, the Shore D hardness difference between the hardness (Q) at the region located 15 mm from the center of the solid core and the hardness (S) at the surface of the core, expressed as (Q)−(S), is at least 1, preferably at least 1.2, more preferably at least 1.5, and most preferably at least 1.7, but not more than 10, preferably not more than 8, more preferably not more than 6, and most preferably not more than 4.

To enhance the rebound of the ball from suitable ball deformation on shots with a driver at low head speeds, and to improve both the feel on impact and the scuff resistance of the ball, the Shore D hardness difference between the hardness (S) at the surface of the solid core and the hardness (R) of the core 2 to 3 mm inside the core surface, expressed as (S)−(R), is at least 3, preferably at least 3.5, and more preferably at least 4, but not more than 10, preferably not more than 8, more preferably not more than 7, and most preferably not more than 6.

It is recommended that the solid core have a diameter of at least 37.6 mm, preferably at least 38.2 mm, and most preferably at least 38.8 mm, but not more than 43.0 mm, preferably not more than 42.0 mm, even more preferably not more than 41.0 mm, yet more preferably not more than 40.5 mm, and most preferably not more than 40.1 mm.

It is recommended that the solid core have a specific gravity of generally at least 0.9, preferably at least 1.0, and more preferably at least 1.1, but not more than 1.4, preferably not more than 1.3, and even more preferably not more than 1.2.

To ensure good adhesion between the cover layer and the solid core, and also good durability, it is desirable to treat the surface of the solid core with a primer. Specifically, an adhesive layer may be provided between the solid core and the cover layer in order to enhance the durability of the ball when struck. Examples of adhesives suitable for this purpose include epoxy resin adhesives, vinyl resin adhesives, and rubber adhesives. The use of a urethane resin adhesive or a chlorinated polyolefin adhesive is especially preferred.

The adhesive layer may be formed by dispersion coating. No particular limitation is imposed on the type of emulsion used for dispersion coating. The resin powder used for preparing the emulsion may be a thermoplastic resin powder or a thermoset resin powder. Illustrative examples of suitable resins include vinyl acetate resins, vinyl acetate copolymer resins, ethylene-vinyl acetate (EVA) copolymer resins, acrylate polymer or copolymer resins, epoxy resins, thermoset urethane resins, and thermoplastic urethane resins. Of these, epoxy resins, thermoset urethane resins, thermoplastic urethane resins and acrylate polymer or copolymer resins are preferred. A thermoplastic urethane resin is especially preferred.

The adhesive layer has a thickness of preferably 0.1 to 30 μm, more preferably 0.2 to 25 μm, and especially 0.3 to 20 μm.

In the practice of the invention, the cover layer is formed primarily of a polyurethane material, especially a thermoplastic or thermoset polyurethane material. By forming a solid golf ball in which the cover layer is composed primarily of such a polyurethane material, it is possible to achieve an excellent feel, controllability, cut resistance, scuff resistance and durability to cracking on repeated impact without a loss of rebound. The cover may be composed of a single layer or may have a multilayer construction of two or more layers, in which case it is critical for the outermost layer of the cover to be composed primarily of the thermoplastic or thermoset polyurethane material described here.

The cover layer in this case is exemplified by a cover layer made from a cover stock (C) composed primarily of the following components A and B:

(A) a thermoplastic polyurethane material; and (B) an isocyanate mixture prepared by dispersing (b-1) an isocyanate compound having as functional groups at least two isocyanate groups per molecule in (b-2) a thermoplastic resin that is substantially non-reactive with isocyanate.

When the cover layer is formed using the above-described cover stock (C), golf balls having a better feel, controllability, cut resistance, scuff resistance and durability to cracking with repeated impact can be obtained.

Next, above components A to C are described.

(A) The thermoplastic polyurethane material has a morphology which includes soft segments composed of a high-molecular-weight polyol (polymeric glycol) and hard segments composed of a chain extender and a diisocyanate. Here, the high-molecular-weight polyol used as a starting material may be any that is employed in the art relating to thermoplastic polyurethane materials, without particular limitation. Exemplary high-molecular-weight polyols include polyester polyols and polyether polyols, although polyether polyols are better than polyester polyols for synthesizing thermoplastic polyurethane materials having a high rebound resilience and excellent low-temperature properties. Suitable polyether polyols include polytetramethylene glycol and polypropylene glycol. Polytetramethylene glycol is especially preferred from the standpoint of rebound resilience and low-temperature properties. The high-molecular-weight polyol has an average molecular weight of preferably from 1,000 to 5,000. To synthesize a thermoplastic polyurethane material having a high rebound resilience, an average molecular weight of from 2,000 to 4,000 is especially preferred.

Preferred chain extenders include those used in the prior art relating to thermoplastic polyurethane materials. Illustrative, non-limiting examples include 1,4-butylene glycol, 1,2-ethylene glycol, 1,3-butanediol, 1,6-hexanediol, and 2,2-dimethyl-1,3-propanediol. These chain extenders have an average molecular weight of preferably from 20 to 15,000.

Diisocyanates suitable for use include those employed in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. Depending on the type of isocyanate used, the crosslinking reaction during injection molding may be difficult to control. In the present invention, to ensure stable reactivity with the subsequently described isocyanate mixture (B), it is most preferable to use an aromatic diisocyanate, and specifically 4,4'-diphenylmethane diisocyanate.

A commercial product may be suitably used as the above-described thermoplastic polyurethane material. Illustrative examples include Pandex T-8290, Pandex T-8295 and Pandex T-8260 (all manufactured by DIC Bayer Polymer, Ltd.), and Resamine 2593 and Resamine 2597 (both manufactured by Dainichi Seika Colour & Chemicals Mfg. Co., Ltd.).

The isocyanate mixture (B) is prepared by dispersing (b-1) an isocyanate compound having as functional groups at least two isocyanate groups per molecule in (b-2) a thermoplastic resin that is substantially non-reactive with isocyanate. Above isocyanate compound (b-1) is preferably an isocyanate compound used in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. From the standpoint of reactivity and work safety, the use of 4,4'-diphenylmethane diisocyanate is most preferred.

The thermoplastic resin (b-2) is preferably a resin having a low water absorption and excellent compatibility with thermoplastic polyurethane materials. Illustrative, non-limiting, examples of such resins include polystyrene resins, polyvinyl chloride resins, ABS resins, polycarbonate resins and polyester elastomers (e.g., polyether-ester block copolymers, polyester-ester block copolymers). From the standpoint of rebound resilience and strength, the use of a polyester elastomer, particularly a polyether-ester block copolymer, is especially preferred.

In the isocyanate mixture (B), it is desirable for the relative proportions of the thermoplastic resin (b-2) and the isocyanate compound (b-1), expressed as the weight ratio (b-2):(b-1), to be from 100:5 to 100:100, and especially from 100:10 to 100:40. If the amount of the isocyanate compound (b-1) relative to the thermoplastic resin (b-2) is too low, a greater amount of the isocyanate mixture (B) will have to be added to achieve an amount of addition sufficient for the crosslinking reaction with the thermoplastic polyurethane material (A). As a result, the thermoplastic resin (b-2) will exert a large influence, which will compromise the physical properties of the cover stock (C). On the other hand, if the amount of the isocyanate compound (b-1) relative to the thermoplastic resin (b-2) is too large, the isocyanate compound (b-1) may cause slippage to occur during mixing, making preparation of the isocyanate mixture (B) difficult.

The isocyanate mixture (B) can be obtained by, for example, blending the isocyanate compound (b-1) in the thermoplastic resin (b-2) and thoroughly working together these components at a temperature of 130 to 250° C. using mixing rolls or a Banbury mixer, then either pelletizing or cooling and subsequently grinding. A commercial product such as Crossnate EM30 (made by Dainichi Seika Colour & Chemicals Mfg. Co., Ltd.) may be suitably used as the isocyanate mixture (B).

The cover stock (C) is composed primarily of the above-described thermoplastic polyurethane material (A) and isocyanate mixture (B). The relative proportion of the thermoplastic polyurethane material (A) to the isocyanate mixture (B) in the cover stock (C), expressed as the weight ratio (A):(B), is preferably from 100:1 to 100:100, more preferably from 100:5 to 100:50, and even more preferably from 100:10 to 100:30. If too little isocyanate mixture (B) is included with respect to the thermoplastic polyurethane material (A), a sufficient crosslinking effect will not be achieved. On the other hand, if too much is included, unreacted isocyanate may discolor the molded material.

In addition to the above-described ingredients, other ingredients may be included in the cover stock (C). For example, thermoplastic polymeric materials other than the thermoplastic polyurethane material may be included; illustrative examples include polyester elastomers, polyamide elastomers, ionomer resins, styrene block elastomers, polyethylene and nylon resins. Thermoplastic polymeric materials other than the thermoplastic polyurethane material may be included in an amount of 0 to 100 parts by weight, preferably 10 to 75 parts by weight, and more preferably 10 to 50 parts by weight, per 100 parts by weight of the thermoplastic polyurethane material serving as the essential component. The amount of thermoplastic polymeric materials used is selected as appropriate for such purposes as adjusting the hardness of the cover material, improving the resilience, improving the flow properties, and improving adhesion. If necessary, various additives such as pigments, dispersants, antioxidants, light stabilizers, ultraviolet absorbers and parting agents may also be suitably included in the cover stock (C).

Molding of the cover from the cover stock (C) can be carried out by adding the isocyanate mixture (B) to the thermoplastic polyurethane material (A) and dry mixing, then using an injection molding machine to mold the mixture into a cover over the core. The molding temperature varies with the type of thermoplastic polyurethane material (A), although molding is generally carried out within a temperature range of 150 to 250° C.

Reactions and crosslinking which take place in the golf ball cover thus obtained are believed to involve the reaction of isocyanate groups with hydroxyl groups remaining on the thermoplastic polyurethane material to form urethane bonds, or the formation of an allophanate or biuret crosslinked form via a reaction involving the addition of isocyanate groups to urethane groups on the thermoplastic polyurethane material. Although the crosslinking reaction has not yet proceeded to a sufficient degree immediately after injection molding of the cover stock (C), the crosslinking reaction can be made to proceed further by carrying out an annealing step after molding, in this way conferring the golf ball cover with useful characteristics. "Annealing," as used herein, refers to heat aging the cover at a constant temperature for a given length of time, or aging the cover for a fixed period at room temperature.

The cover layer has a hardness at the surface thereof, in Shore D hardness units, of at least 50, preferably at least 53, more preferably at least 56, even more preferably at least 58, and most preferably at least 60, but not more than 70, preferably not more than 68, more preferably not more than 66, and most preferably not more than 65. If the cover is too soft, the ball will have a greater spin receptivity and an inadequate rebound, shortening the distance of travel, in addition to which the cover will have a poor scuff resistance. On the other hand, if the cover is too hard, the durability to cracking with repeated impact will decrease and the feel of the ball during the short game and when hit with a putter will worsen. The Shore D hardness of the cover is the value measured with a type D durometer according to ASTM D2240.

The cover material has a flexural rigidity of at least 50 MPa, preferably at least 60 MPa, and more preferably at least 70 MPa, but not more than 300 MPa, preferably not more than 280 MPa, even more preferably not more than 260 MPa, and most preferably not more than 240 MPa. By giving the cover a flexural rigidity that is low relative to its hardness, there can be obtained a cover stock suitable for attaining good spin characteristics and controllability on approach shots.

To achieve the desired spin properties on shots taken with a driver, it is desirable for the core to have a surface hardness which is lower than the surface hardness of the cover. Specifically, the surface hardness difference between the core and the cover in Shore D hardness units, while not subject to any particular limitation, is set to preferably at least 5, more preferably at least 7, even more preferably at least 8, and most preferably at least 10, but typically not more than 20, preferably not more than 19, more preferably not more than 18, and even more preferably not more than 17.

The cover layer has a thickness of at least 0.5 mm, preferably at least 0.8 mm, more preferably at least 1.1 mm, even more preferably at least 1.4 mm, and most preferably at least 1.7 mm, but not more than 2.5 mm, preferably not more than 2.3 mm, more preferably not more than 2.1 mm, and most preferably not more than 2.0 mm. If the cover is too thin, the durability to cracking with repeated impact will worsen and the resin will have difficulty spreading properly through the top portion of the mold during injection molding, which may result in a poor sphericity. On the other hand, if the cover is too thick, the ball will take on increased spin when hit with a number one wood (W#1), lowering the rebound and thus shortening the carry, in addition to which the ball will have too hard a feel on impact.

The cover layer in the inventive golf ball may be formed using a suitable known method, such as by injection-molding the cover stock directly over the core, or by covering the core with two half-cups that have been molded beforehand as hemispherical shells, then molding under applied heat and pressure.

Numerous dimples are formed on the surface of the golf ball (surface of the cover layer). The number of dimples is generally at least 250, preferably at least 270, more preferably at least 290, and most preferably at least 310, but generally not more than 420, preferably not more than 415, more preferably not more than 410, and most preferably not more than 405. In the invention, within this range, the ball readily undergoes lift and the distance traveled by the ball on shots taken with a driver can be increased. To achieve a suitable trajectory, it is desirable for the dimples to be given a shape that is circular as seen from above. The average dimple diameter is preferably at least 3.7 mm, and more preferably at least 3.75 mm, but preferably not more than 5.0 mm, more preferably not more than 4.7 mm, even more preferably not more than 4.4 mm, and most preferably not more than 4.2 mm. The average dimple depth is preferably at least 0.125 mm, more preferably at least 0.130 mm, even more preferably at least 0.133 mm, and most preferably at least 0.135 mm, but preferably not more than 0.150 mm, more preferably not more than 0.148 mm, even more preferably not more than 0.146 mm, and most preferably not more than 0.144 mm. Moreover, the dimples are composed of preferably at least 4 types, more preferably at least 5 types, and even more preferably at least 6 types, of mutually differing diameter and/or depth. While there is no particular upper limit on the number of dimple types, it is recommended that there be not more than 20 types, preferably not more than 15 types, and most preferably not more than 12 types.

As used herein, "average depth" refers to the mean value for the depths of all the dimples. The diameter of a dimple is measured as the distance across the dimple between positions where the dimple region meets land areas (non-dimple regions), that is, between the highest points of the dimple region. The golf ball is usually painted, in which case the dimple diameter refers to the diameter when the surface of the ball is covered with paint. The depth of a dimple is measured by connecting together the positions where the dimple meets the surrounding land areas so as to define an imaginary flat plane, and determining the vertical distance from a center position on the flat plane to the bottom (deepest position) of the dimple.

If necessary, the surface of the solid golf ball can be marked, painted and surface treated.

The solid golf ball of the invention has a deformation, when compressed under a final load of 130 kgf from an initial load of 10 kgf, of at least 2.0 mm, preferably at least 2.2 mm, more preferably at least 2.4 mm, and even more preferably at least 2.5 mm, but not more than 3.8 mm, preferably not more than 3.6 mm, more preferably not more than 3.4 mm, and most preferably not more than 3.1 mm.

The solid golf ball of the invention can be produced in accordance with the Rules of Golf for use in competitive play, in which case the ball may be formed to a diameter of not less than 42.67 mm and a weight of not more than 45.93 g. The upper limit for the diameter is generally not more than 44.0 mm, preferably not more than 43.8 mm, more preferably not more than 43.5 mm, and most preferably not more than 43.0 mm. The lower limit for the weight is generally not less than 44.5 g, preferably not less than 45.0 g, more preferably not less than 45.1 g, and even more preferably not less than 45.2 g.

The solid golf ball of the invention can be manufactured using an ordinary process such as a known injection molding process. For example, a molded and vulcanized material composed primarily of the base rubber is placed as the solid core within a specific injection-molding mold, following which the cover stock is injection-molded over the core to give the golf ball. Alternatively, the solid core may be enclosed within two half-cups that have been molded beforehand as hemispherical shells, and molding subsequently carried out under applied heat and pressure.

As described above, in the solid golf ball of the invention, by optimizing the hardness distribution of the solid core, the selection of the cover stock, the hardnesses of the solid core and the cover, and the amount of deflection by the ball as a whole, the rebound can be enhanced even further and the spin rate of the ball can be reduced, especially on full shots with a driver at low head speeds (HS) of from 30 to 40 m/s, increasing the distance traveled by the ball. Also, by having the hardness at the core surface be lower than the hardness at the core interior, a good feel on impact can be achieved. Moreover, compared with an ordinary ionomer cover, the cover has a flexural rigidity that is relatively low for its hardness, resulting in an excellent spin performance on approach shots and a very high spin stability. In addition, the inventive solid golf ball also has an excellent scuff resistance and excellent durability to cracking on repeated impact, making it overall a highly advantageous ball for use in competitive play.

EXAMPLES

The following Examples of the invention and Comparative Examples are provided by way of illustration and not by way of limitation.

Examples 1 to 9, and Comparative Examples 1 to 8

In each example, a solid core was produced by preparing a core composition having one of formulations No. 1 to No. 13 shown in Table 3, then molding and vulcanizing the composition under the vulcanization conditions in Table 3. Next, a single-layer cover was formed by injection-molding one of the formulations A to E shown in Table 4 about the core, thereby encasing the solid core within a cover. In addition, a plurality of dimple types were used in combination, giving a two-piece solid golf ball having 330 dimples (Configuration I), 432 dimples (Configuration II), or 500 dimples (Configuration III).

TABLE 3

| | | Formulation No. | | | | | | | | | | | | |
|---|---|---|---|---|---|---|---|---|---|---|---|---|---|---|
| | | 1 | 2 | 3 | 4 | 5 | 6 | 7 | 8 | 9 | 10 | 11 | 12 | 13 |
| Core formulations | BR11 | | | | | | | | | | | | | 100 |
| | BR730 | 100 | 100 | 100 | 100 | 100 | 100 | 70 | 100 | 100 | 100 | 100 | 100 | |
| | BR51 | | | | | | | 30 | | | | | | |
| | Perhexa C-40 | 0.3 | 0.3 | 0.3 | 0.3 | 0.3 | 0.3 | 0.45 | 0.3 | 0.3 | 0.3 | 0.8 | 0.3 | 0.6 |
| | (true amount added) | 0.12 | 0.12 | 0.12 | 0.12 | 0.12 | 0.18 | 0.12 | 0.12 | 0.12 | 0.32 | 0.12 | 0.24 | |
| | Percumyl D | 0.3 | 0.3 | 0.3 | 0.3 | 0.3 | 0.3 | 0.45 | 0.3 | 0.3 | 0.3 | 0.8 | 0.3 | 0.6 |
| | Zinc oxide | 10.9 | 8.3 | 8.7 | 10.8 | 9.9 | 10.9 | 10.7 | 8.8 | 13.4 | 11.3 | 11.7 | 20.4 | 10.7 |
| | Antioxidant | 0.3 | 0.6 | 0.4 | 0.3 | 0.3 | 0.3 | 0.3 | 0.3 | 0.3 | 0.1 | 0.3 | 0.3 | 0.3 |
| | Zinc stearate | 5 | 5 | 5 | 5 | 5 | 5 | 5 | 5 | 5 | 5 | 5 | 5 | 5 |
| | Zinc acrylate | 34 | 40 | 39 | 35 | 37 | 35.5 | 36.5 | 41 | 29 | 32 | 32.5 | 34 | 35 |
| | Zinc salt of pentachlorothiophenol | 1.5 | 1.5 | 1.5 | 1 | 1 | 0.5 | 0.1 | 0 | 1 | 1 | 1 | 1 | 1 |
| Vulcanizing method | Temperature (° C.) | 160 | 160 | 160 | 160 | 145 | 160 | 160 | 160 | 160 | 160 | 160 | 160 | 160 |
| | Time (min) | 15 | 18 | 16 | 15 | 18 | 15 | 15 | 15 | 13 | 13 | 13 | 13 | 13 |

*Numbers in the "Core formulations" section of the table indicate parts by weight.

Trade names for most of the materials appearing in the table are as follows.

| | |
|---|---|
| BR11: | A polybutadiene rubber produced by JSR Corporation using a nickel catalyst; cis-1,4 bond content, 96%; 1,2-vinyl bond content, 2.0%; Mooney viscosity, 43; Mw/Mn = 4.1. |
| BR730: | A polybutadiene rubber produced by JSR Corporation using a neodymium catalyst; cis-1,4 bond content, 96%; 1,2-vinyl bond content, 1.3%; Mooney viscosity, 55; Mw/Mn = 3. |

-continued

| | |
|---|---|
| BR51: | A polybutadiene rubber produced by JSR Corporation using a neodymium catalyst; cis-1,4 bond content, 96%; 1,2-vinyl bond content, 1.3%; Mooney viscosity, 35.5; Mw/Mn = 2.8. |
| Perhexa C-40: | 1,1-Bis(t-butylperoxy)cyclohexane, 40% dilution; produced by NOF Corporation. Because Perhexa C-40 is a 40% dilution, the true amount of addition is also indicated in the above table. |
| Percumyl D: | Dicumyl peroxide, produced by NOF Corporation. |
| Zinc oxide: | Produced by Sakai Chemical Industry Co., Ltd. |
| Antioxidant: | 2,2'-Methylenebis(4-methyl-6-t-butylphenol), produced as Nocrac NS-6 by Ouchi Shinko Chemical Industry Co. |
| Zinc acrylate: | Produced by Nihon Jyoryu Kogyo Co., Ltd. |
| Zinc stearate: | Produced by NOF Corporation. |

TABLE 4

| | A | B | C | D | E |
|---|---|---|---|---|---|
| Himilan 1605 | | | | 50 | |
| Himilan 1706 | | | | 50 | |
| Himilan 1601 | | | | | 50 |
| Himilan 1557 | | | | | 50 |
| Pandex T8260 | 50 | 100 | | | |
| Pandex T8295 | 50 | | 75 | | |
| Pandex T8290 | | | 25 | | |
| Titanium dioxide | 4 | 4 | 4 | 4.8 | 4.8 |
| Polyethylene wax | 1.5 | 1.5 | 1.5 | 2 | 2 |

TABLE 4-continued

| | A | B | C | D | E |
|---|---|---|---|---|---|
| Isocyanate compound | 20 | 20 | 20 | | |

*Numbers in the table indicate parts by weight.

Trade names for most of the materials appearing in the table are as follows.

| | |
|---|---|
| Himilan series: | Ionomer resins produced by DuPont-Mitsui Polychemicals Co., Ltd. |
| Pandex series: | Thermoplastic polyurethane elastomers produced by Dainippon Ink & Chemicals, Inc. |
| Isocyanate compound: | The isocyanate compound produced by Dainichi Seika Colour & Chemicals Mfg. Co., Ltd. under the trade name Crossnate EM30. |

Figure 2:
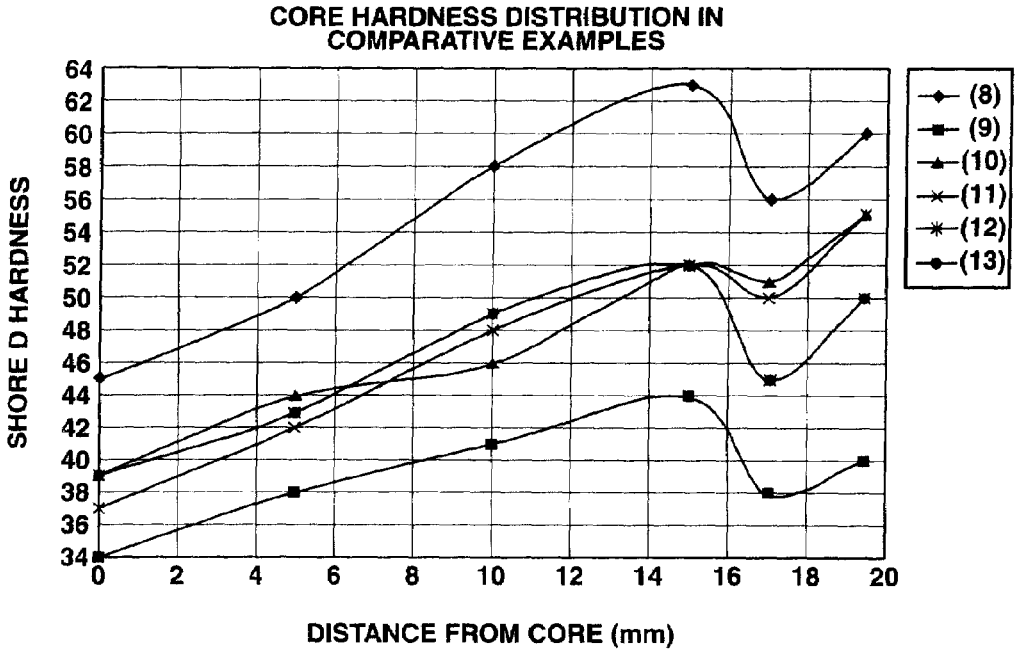
FIG. 2 shows the core hardness distributions for core formulations No. 8 to No. 13 used in the comparative examples.

The golf balls obtained in above Examples 1 to 9 and Comparative Examples 1 to 8 were each evaluated for ball deflection, ball properties, flight performance, spin rate on approach shots, scuff resistance and feel on impact. The results are shown in Tables 5 and 6. The core hardness distributions in the examples of the invention and the comparative examples using core formulations No. 1 to No. 13 are shown in FIGS. 1 and 2.

Hardness Distribution of Solid Core (Shore D Hardness)

The balls were temperature conditioned at 23° C., following which the hardnesses at various positions were measured in terms of the Shore D hardness (using a type D durometer in accordance with ASTM-2240).

Each surface hardness value shown in the table was obtained by measuring the hardness at two randomly chosen points on the surface of each of five cores, and determining the average of the measured values.

Each center hardness value shown in the table was obtained by cutting the solid core into two halves with a fine cutter, measuring the hardness at the center of the sectioned planes on the two hemispheres for each of five cores, and determining the average of the measured values.

Cross-sectional hardness values were obtained by cutting the solid core into two halves and measuring the hardnesses at regions located 5 mm, 10 mm and 15 mm from the center of the cross-section and at the region located 2 to 3 mm inside of the surface. The values shown in the table are average hardness values for the respective regions on the sectioned planes of two hemispheres for each of five cores.

Surface Hardness of Cover

The balls were temperature conditioned at 23° C., following which the hardnesses at two randomly chosen points in undimpled land areas on the surface of each of five balls were measured. Measurements were conducted with a type D durometer in accordance with ASTM-2240.

Deflection of Solid Core and Finished Ball

Using an Instron model 4204 test system manufactured by Instron Corporation, solid cores and finished balls were each compressed at a rate of 10 mm/min, and the difference between deformation at 10 kg and deformation at 130 kg was measured.

Initial Velocity

The initial velocity was measured using an initial velocity measuring apparatus of the same type as the USGA drum rotation-type initial velocity instrument approved by the R&A. The ball was temperature conditioned at 23±1° C. for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken by a ball to traverse a distance of 6.28 ft (1.91 m) was measured and used to compute the initial velocity of the ball. This cycle was carried out over a period of about 15 minutes.

Distance

The total distance traveled by the ball when hit at a head speed (HS) of 40 m/s with a driver (Tour Stage X-DRIVE TYPE 350 PROSPEC, manufactured by Bridgestone Sports Co., Ltd.; loft angle, 10.5°) mounted on a swing robot (Miyamae Co., Ltd.) was measured. The spin rate was measured from high-speed camera images of the ball taken immediately after impact.

Spin Rate on Approach Shots

The spin rate of a ball hit at a head speed of 20 m/s with a sand wedge (abbreviated below as "SW"; Tour Stage X-wedge, manufactured by Bridgestone Sports Co., Ltd.; loft angle, 58°) was measured. The spin rate was measured by the same method as that used above when measuring distance.

Feel

The feel of each ball when teed up and hit with a driver at a head speed of 40 m/s and when hit with a putter was evaluated by ten amateur golfers, and was rated as indicated below based on the number of golfers who responded that the ball had a "soft" feel. An X-DRIVE TYPE 350 PROSPEC having a loft angle of 10° was used as the driver, and a Tour Stage ViQ Model-III was used as the putter. Both clubs are manufactured by Bridgestone Sports Co., Ltd.

NG: 1 to 3 golfers rated the ball as "soft."

Ordinary: 4 to 6 golfers rated the ball as "soft."

Good: 7 to 10 golfers rated the ball as "soft."

Scuff Resistance

Each ball was temperature conditioned at 23° C., then hit at a head speed of 33 m/s with a square-grooved pitching wedge mounted on a swing robot. The condition of the ball after being hit was rated visually by three judges according to the following criteria. Results shown in the table are the average point values obtained for each ball.

10 points: No visible defects.

8 points: Substantially no defects.

5 points: Some defects noted, but ball can be re-used.

3 points: Condition is borderline, but ball can be re-used.

1 point: Unfit for reuse.

TABLE 5

| | | | Example | | | | | | | | |
|---|---|---|---|---|---|---|---|---|---|---|---|
| | | | 1 | 2 | 3 | 4 | 5 | 6 | 7 | 8 | 9 |
| Solid core | Type | | No. 1 | No. 2 | No. 3 | No. 4 | No. 4 | No. 5 | No. 6 | No. 7 | No. 4 |
| | Diameter (mm) | | 38.9 | 38.9 | 38.9 | 38.9 | 38.9 | 38.9 | 38.9 | 38.9 | 38.0 |
| | Deflection (mm) | | 3.6 | 2.8 | 2.8 | 3.2 | 3.2 | 2.8 | 2.8 | 2.4 | 3.2 |
| | Hardness distribution (Shore D) | Center | 37 | 39 | 40 | 39 | 39 | 42 | 41 | 42 | 39 |
| | | Region 5 mm from center | 41 | 43 | 44 | 43 | 43 | 45 | 45 | 47 | 43 |

TABLE 5-continued

| | | | Example | | | | | | | | |
|---|---|---|---|---|---|---|---|---|---|---|---|
| | | | 1 | 2 | 3 | 4 | 5 | 6 | 7 | 8 | 9 |
| | | Region 10 mm from center | 45 | 51 | 51 | 49 | 49 | 51 | 51 | 54 | 49 |
| | | Region 15 mm from center (Q) | 48 | 54 | 54 | 52 | 52 | 55 | 54 | 58 | 52 |
| | | Region 2-3 mm inside surface (R) | 42 | 44 | 45 | 45 | 45 | 46 | 47 | 50 | 45 |
| | | Surface (S) | 46 | 50 | 51 | 50 | 50 | 51 | 52 | 55 | 50 |
| | | Hardness difference (Q) − (S) | 2 | 4 | 3 | 2 | 2 | 4 | 2 | 3 | 2 |
| | | Hardness difference (S) − (R) | 4 | 6 | 6 | 5 | 5 | 5 | 5 | 5 | 5 |
| | Hardness difference between center and surface | | 9 | 11 | 11 | 11 | 11 | 9 | 11 | 13 | 11 |
| Cover layer | Type | | A | B | B | A | A | C | A | A | A |
| | Surface hardness | | 64 | 67 | 67 | 64 | 64 | 59 | 64 | 64 | 64 |
| | Flexural rigidity (kgf/cm$^2$) | | 181 | 287 | 287 | 181 | 181 | 88 | 181 | 181 | 181 |
| Finished ball | Hardness difference between cover surface and core surface | | 18 | 17 | 16 | 14 | 14 | 8 | 12 | 9 | 14 |
| | Deflection (mm) | | 3.1 | 2.6 | 2.5 | 2.8 | 2.8 | 2.5 | 2.4 | 2.1 | 2.7 |
| | Diameter (mm) | | 42.7 | 42.7 | 42.7 | 42.7 | 42.7 | 42.7 | 42.7 | 42.7 | 42.7 |
| | Weight (g) | | 45.5 | 45.5 | 45.5 | 45.5 | 45.5 | 45.5 | 45.5 | 45.5 | 45.6 |
| | Specific gravity | | 1.16 | 1.16 | 1.16 | 1.16 | 1.16 | 1.16 | 1.16 | 1.16 | 1.16 |
| | Thickness (mm) | | 1.9 | 1.9 | 1.9 | 1.9 | 1.9 | 1.9 | 1.9 | 1.9 | 2.4 |
| Dimples | Number of dimples | | 330 | 330 | 330 | 432 | 330 | 432 | 432 | 432 | 432 |
| | Average dimple depth (mm) | | 0.146 | 0.146 | 0.146 | 0.142 | 0.146 | 0.142 | 0.142 | 0.142 | 0.142 |
| | Average dimple diameter (mm) | | 4.2 | 4.2 | 4.2 | 3.6 | 4.2 | 3.6 | 3.6 | 3.6 | 3.6 |
| | Number of dimple types | | 6 | 6 | 6 | 5 | 6 | 5 | 5 | 5 | 5 |
| Distance | Spin rate (rpm) | | 2860 | 3080 | 3050 | 2950 | 2950 | 3040 | 3010 | 3080 | 2990 |
| | Total distance (m) | | 205.5 | 206.5 | 207.5 | 205.5 | 207.0 | 205.0 | 206.5 | 205.0 | 203.5 |
| Spin rate on approach shots (rpm) | | | 6160 | 6380 | 6320 | 6250 | 6250 | 6620 | 6310 | 6370 | 6340 |
| Initial velocity (m/s) | | | 77.2 | 77.2 | 77.3 | 77.2 | 77.2 | 77.2 | 77.4 | 77.5 | 76.9 |
| Scuff resistance | | | 6.5 | 6.5 | 6.5 | 6.0 | 6.0 | 5.5 | 5.5 | 5.0 | 5.5 |
| Feel on impact | Driver | | Good | Good | Good | Good | Good | Good | Good | Ordinary | Good |
| | Putter | | Good | Good | Ordinary | Good | Good | Good | Good | Ordinary | Good |

TABLE 6

| | | | Comparative Example | | | | | | | |
|---|---|---|---|---|---|---|---|---|---|---|
| | | | 1 | 2 | 3 | 4 | 5 | 6 | 7 | 8 |
| Solid core | Type | | No. 8 | No. 9 | No. 10 | No. 4 | No. 11 | No. 12 | No. 13 | No. 12 |
| | Diameter (mm) | | 38.9 | 38.9 | 38.9 | 37.5 | 38.9 | 38.9 | 38.9 | 38.9 |
| | Deflection (mm) | | 1.9 | 4.2 | 3.4 | 3.2 | 3.2 | 3.2 | 3.2 | 3.2 |
| | Hardness distribution (Shore D) | Center | 45 | 34 | 39 | 39 | 37 | 39 | 39 | 39 |
| | | Region 5 mm from center | 50 | 38 | 44 | 43 | 42 | 43 | 43 | 43 |
| | | Region 10 mm from center | 58 | 41 | 46 | 50 | 48 | 49 | 49 | 49 |
| | | Region 15 mm from center (Q) | 63 | 44 | 52 | 50 | 52 | 52 | 52 | 52 |
| | | Region 2-3 mm inside surface (R) | 56 | 38 | 51 | 45 | 50 | 45 | 45 | 45 |
| | | Surface (S) | 60 | 40 | 55 | 50 | 55 | 50 | 50 | 50 |
| | | Hardness difference (Q) − (S) | 3 | 4 | −3 | 0 | −3 | 2 | 2 | 2 |
| | | Hardness difference (S) − (R) | 4 | 2 | 4 | 5 | 5 | 5 | 5 | 5 |
| | Hardness difference between center and surface | | 15 | 6 | 16 | 11 | 18 | 11 | 11 | 11 |
| Cover layer | Type | | A | A | A | A | A | D | A | E |
| | Surface hardness | | 64 | 64 | 64 | 64 | 64 | 72 | 64 | 64 |
| | Flexural rigidity (kgf/cm$^2$) | | 181 | 181 | 181 | 181 | 181 | 400 | 181 | 200 |
| Finished ball | Hardness difference between cover surface and core surface | | 4 | 24 | 9 | 14 | 9 | 22 | 14 | 14 |
| | Deflection (mm) | | 1.7 | 3.7 | 2.9 | 2.5 | 2.7 | 2.1 | 2.8 | 2.8 |
| | Diameter (mm) | | 42.7 | 42.7 | 42.7 | 42.7 | 42.7 | 42.7 | 42.7 | 42.7 |
| | Weight (g) | | 45.5 | 45.5 | 45.5 | 45.7 | 45.5 | 45.5 | 45.5 | 45.5 |
| | Specific gravity | | 1.16 | 1.16 | 1.16 | 1.16 | 1.16 | 0.99 | 1.16 | 0.99 |
| | Thickness (mm) | | 1.9 | 1.9 | 1.9 | 2.6 | 1.9 | 1.9 | 1.9 | 1.9 |

TABLE 6-continued

| | | Comparative Example | | | | | | | |
|---|---|---|---|---|---|---|---|---|---|
| | | 1 | 2 | 3 | 4 | 5 | 6 | 7 | 8 |
| Dimples | Number of dimples | 330 | 330 | 500 | 330 | 330 | 330 | 330 | 330 |
| | Average dimple depth (mm) | 0.146 | 0.146 | 0.153 | 0.146 | 0.146 | 0.146 | 0.146 | 0.146 |
| | Average dimple diameter (mm) | 4.2 | 4.2 | 3.1 | 4.2 | 4.2 | 4.2 | 4.2 | 4.2 |
| | Number of dimple types | 6 | 6 | 3 | 6 | 6 | 6 | 6 | 6 |
| Distance | Spin rate (rpm) | 3570 | 2710 | 2880 | 3020 | 2910 | 2720 | 2950 | 2870 |
| | Total distance (m) | 202.5 | 199.5 | 199.0 | 199.0 | 200.0 | 204.0 | 199.5 | 197.5 |
| Spin rate on approach shots (rpm) | | 6820 | 5870 | 6170 | 6380 | 6190 | 4220 | 6270 | 6010 |
| Initial velocity (m/s) | | 77.5 | 76.7 | 77.3 | 76.6 | 76.8 | 76.9 | 76.6 | 76.3 |
| Scuff resistance | | 2.5 | 7.0 | 5.5 | 4.5 | 5.0 | 6.0 | 6.0 | 2.0 |
| Feel on impact | Driver | NG | Good | NG | NG | NG | Ordinary | Good | Good |
| | Putter | NG | Good | Ordinary | Good | Ordinary | NG | Good | Good |

The results in Tables 5 and 6 show that, in Comparative Example 1, the finished ball had a hardness that was too high, resulting in a hard feel on impact, and also resulting in an excessive spin rate which shortened the distance traveled by the ball. In Comparative Example 2, the core hardness was too low, reducing the rebound and shortening the distance traveled by the ball, and also lowering the performance of the ball on approach shots. In Comparative Example 3, because the core had a surface hardness which was higher than the hardness of the region located 15 mm from the core center, the distance traveled by the ball when hit at a head speed (HS) of 40 m/s decreased, in addition to which the ball also had a harder feel on impact. In Comparative Example 4, the cover was too thick, as a result of which a good rebound was not obtained, shortening the distance traveled by the ball. In Comparative Example 5, because the core had a surface hardness which was higher than the hardness of the region located 15 mm from the core center, the distance traveled by the ball when hit at a head speed (HS) of 40 m/s decreased, in addition to which the ball also had a harder feel on impact. In Comparative Example 6, the cover was made of a hard ionomer, giving the ball a very poor controllability (spin rate) on approach shots, in addition to which the feel on shots with a putter was also poor. In Comparative Example 7, the use of a polybutadiene rubber synthesized with a nickel catalyst as the core material resulted in a lower rebound and thus a shorter distance. In Comparative Example 8, a soft ionomer cover was used, resulting in a lower rebound and thus a shorter distance, and resulting also in a poor scuff resistance.

The invention claimed is:

1. A solid golf ball comprising a solid core and a cover layer that encases the core and has an outermost layer on an outside surface of which are formed a plurality of dimples, wherein the solid core is formed of a rubber composition composed of 100 parts by weight of a base rubber that includes from 60 to 100 parts by weight of a polybutadiene rubber having a cis-1,4 bond content of at least 60% and having a Mooney viscosity ($ML_{1+4}$(100° C.)) of from 30 to 100 and synthesized using a rare-earth catalyst, from 0.1 to 5 parts by weight of an organosulfur compound, an unsaturated carboxylic acid or a metal salt thereof, an inorganic filler, and an antioxidant; the solid core has a deformation, when compressed under a final load of 130 kgf from an initial load of 10 kgf, of from 2.0 to 4.0 mm, and has the hardness distribution shown in the table below; the cover layer is formed primarily of a polyurethane material and has a thickness of from 0.5 to 2.5 mm, a Shore D hardness at the surface of from 50 to 70 and a flexural rigidity of from 50 to 300 MPa; and the golf ball has a deformation, when compressed under a final load of 130 kgf from an initial load of 10 kgf, of from 2.0 to 3.8 mm;

| Hardness Distribution in Solid Core | Shore D hardness |
|---|---|
| Center | 30 to 48 |
| Region located 5 mm from center | 34 to 52 |
| Region located 10 mm from center | 40 to 58 |
| Region located 15 mm from center (Q) | 43 to 61 |
| Region located 2 to 3 mm inside of surface (R) | 36 to 54 |
| Surface (S) | 41 to 59 |
| Hardness difference ((Q) − (S)] | 1 to 10 |
| Hardness difference [(S) − (R)] | 3 to 10. |

2. The solid golf ball of claim 1, wherein the surface hardness of the solid core is lower than the surface hardness of the cover layer, the difference therebetween in Shore D hardness units being from 5 to 20.

3. The solid golf ball of claim 1, wherein the difference between the surface hardness of the solid core and the center hardness of the solid core, in Shore D hardness units, is from 7 to 17.

4. The solid golf ball of claim 1, wherein the solid core has a diameter of from 37.6 to 43.0 mm and the golf ball has a diameter of from 42.67 to 44.0 mm.

5. The solid golf ball of claim 1, wherein the solid core contains from 33 to 45 parts by weight of the unsaturated carboxylic acid or a metal salt thereof, from 0.1 to 1.0 parts by weight of the organic peroxide, from 5 to 80 parts by weight of the inorganic filler, and from 0.2 to 1.0 parts by weight of the antioxidant per 100 parts by weight of the base rubber.

6. The solid golf ball of claim 1, wherein the dimples total in number from 250 to 450, have an average depth of from 0.125 to 0.150 mm and an average diameter of from 3.7 to 5.0 mm for all dimples, and are configured from at least four dimple types.

7. The solid golf ball of claim 1, wherein the polybutadiene has a Mooney viscosity ($ML_{1+4}$(100° C.)) of from 50 to 60.

8. The solid golf ball of claim 1, wherein the polybutadiene has a Mooney viscosity ($ML_{1+4}$(100° C.)) of from 52 to 60.

9. The solid golf ball of claim 1, wherein the polybutadiene has a polydispersity index Mw/Mn of from 2.0 to 6.0.

10. The solid golf ball of claim 1, wherein the polybutadiene has a polydispersity index Mw/Mn of from 2.2 to 3.4.

11. The solid golf ball of claim 1, wherein the amount of antioxidant included per 100 parts by weight of the base rubber is from 0.27 to 0.7 parts by weight.

12. The solid golf ball of claim 1, wherein the amount of antioxidant included per 100 parts by weight of the base rubber is from 0.3 to 0.6 parts by weight.

13. The solid golf ball of claim 1, wherein the cover layer has a thickness of from 0.8 to 2.3 mm.

14. The solid golf ball of claim 1, wherein the cover layer has a thickness of from 1.4 to 2.0 mm.

15. The solid golf ball of claim 1, wherein the flexural rigidity of the cover layer is from 60 to 280 MPa.

16. The solid golf ball of claim 1, wherein the flexural rigidity of the cover layer is from 70 to 240 MPa.

17. The solid golf ball of claim 1, wherein the hardness distribution of the solid core is further shown in the table below:

| Hardness Distribution in Solid Core | Shore D hardness |
|---|---|
| Center | 33 to 45 |
| Region located 5 mm from center | 37 to 49 |
| Region located 10 mm from center | 43 to 55 |
| Region located 15 mm from center (Q) | 46 to 58 |

-continued

| Hardness Distribution in Solid Core | Shore D hardness |
|---|---|
| Region located 2 to 3 mm inside of surface (R) | 39 to 51 |
| Surface (S) | 44 to 56. |

18. The solid golf ball of claim 1, wherein the hardness distribution of the solid core is further shown in the table below;

| Hardness Distribution in Solid Core | Shore D hardness |
|---|---|
| Center | 37 to 43 |
| Region located 5 mm from center | 41 to 47 |
| Region located 10 mm from center | 45 to 55 |
| Region located 15 mm from center (Q) | 50 to 56 |
| Region located 2 to 3 mm inside of surface (R) | 41 to 51 |
| Surface (S) | 46 to 54. |

* * * * *